US005424176A

United States Patent [19]

Schmittou et al.

[11] Patent Number: 5,424,176

[45] Date of Patent: Jun. 13, 1995

[54] ACCELERATION OF SILVER REMOVAL BY THIOETHER COMPOUNDS IN SULFITE FIXER

[75] Inventors: Eric R. Schmittou; Therese M. Feller, both of Rochester; Stuart T. Gordon, Pittsford, all of N.Y.

[73] Assignee: Eastman Kodak Company, Rochester, N.Y.

[21] Appl. No.: 149,500

[22] Filed: Nov. 9, 1993

[51] Int. Cl.[6] ..... G03C 5/38; G03C 7/12

[52] U.S. Cl. ..... 430/429; 430/372; 430/418; 430/428; 430/455; 430/459

[58] Field of Search ..... 430/372, 418, 428, 429, 430/455, 459

[56] References Cited

U.S. PATENT DOCUMENTS

| | | | |
|---|---|---|---|
| H953 | 8/1991 | Goto et al. | 430/430 |
| 2,748,000 | 5/1956 | Mader | 430/393 |
| 3,033,765 | 5/1962 | King et al. | 204/15 |
| 4,126,459 | 11/1978 | Greenwald | 96/29 R |
| 4,211,559 | 7/1980 | Greenwald | 430/566 |
| 4,251,617 | 2/1981 | Bloom et al. | 430/428 |
| 4,267,256 | 5/1981 | Bloom et al. | 430/428 |
| 4,797,352 | 1/1989 | Koboshi et al. | 430/372 |
| 4,914,009 | 4/1990 | Ueda et al. | 430/611 |
| 4,954,426 | 9/1990 | Ishikawa | 430/393 |
| 4,960,683 | 10/1990 | Okazaki et al. | 430/428 |
| 4,983,503 | 1/1991 | Ishikawa et al. | 430/393 |
| 5,002,861 | 3/1991 | Nakazyo et al. | 430/393 |
| 5,068,170 | 11/1991 | Abe | 430/393 |
| 5,093,228 | 3/1992 | Nakamura | 430/393 |
| 5,102,778 | 4/1992 | Nakamura | 430/393 |
| 5,171,658 | 12/1992 | Fyson | 430/393 |

FOREIGN PATENT DOCUMENTS

| | | | |
|---|---|---|---|
| 458277 | 11/1991 | European Pat. Off. . | |
| 61-51147 | 3/1986 | Japan | 430/418 |
| 63-8644 | 1/1988 | Japan | 430/429 |
| 64-21444 | 1/1989 | Japan | 430/455 |
| 4-230749 | 8/1992 | Japan | 430/455 |

*Primary Examiner*—Charles L. Bowers, Jr.
*Assistant Examiner*—J. Pasterczyk
*Attorney, Agent, or Firm*—Sarah Meeks Roberts; J. Lanny Tucker

[57] ABSTRACT

A fixing solution having a pH≧7 and comprising a fixing amount of sulfite and a fix accelerating amount of a thioether compound; wherein the fixing solution contains less than 0.05 moles/liter of thiosulfate and a method of processing an imagewise exposed and developed silver halide photographic element comprising fixing in said fixing solution a silver halide photographic element containing at least one emulsion or deposit of silver halide comprising greater than 90 mole % silver chloride.

18 Claims, No Drawings

ACCELERATION OF SILVER REMOVAL BY THIOETHER COMPOUNDS IN SULFITE FIXER

FIELD OF THE INVENTION

The invention relates to processing of silver halide photographic elements. More specifically, it relates to the fixing of photographic elements comprising silver chloride using an aqueous solution containing sulfite as a fixing agent.

BACKGROUND OF THE INVENTION

The basic image-forming process of silver halide photography comprises the exposure of a silver halide photographic element to actinic radiation (for example, light or X-rays), and the manifestation of a usable image by the wet, chemical processing of the element. The fundamental steps of this processing entail, first, treatment of the photographic element with one or more developing agents wherein some of the silver halide is reduced to metallic silver. With black-and-white photographic materials, the metallic silver usually comprises the desired image. With color photographic materials, the useful image consists of one or more images in organic dyes produced from an oxidized developing agent formed where silver halide is reduced to metallic silver.

To obtain useful black-and-white images it is usually desirable to remove the undeveloped silver halide, and to obtain useful color images it is usually desirable to remove all of the silver from the photographic element after the image has been formed. In black-and-white photography the removal of undeveloped silver halide is accomplished by dissolving it with a silver halide solvent, commonly referred to as a fixing agent. In color photography the removal of silver is generally accomplished by oxidizing the metallic silver, and dissolving the oxidized metallic silver and undeveloped silver halide with a fixing agent. The oxidation of metallic silver is achieved with antioxidizing agent, commonly referred to as a bleaching agent. The dissolution of oxidized silver and undeveloped silver halide can be accomplished concurrently with the bleaching operation in a bleach-fix process using a bleach-fix solution, or subsequent to the bleaching operation by using a separate processing solution containing a fixing agent.

It is highly desirable to process a photographic element as rapidly as feasible, and a shortened process compared to ones known in the art is highly desired. Shortening the silver removal step, which consumes a large amount of the total process time, is one manner in which to shorten the overall processing time. Juxtaposed to the desire for an accelerated process is the desire for, and the need for, photographic elements and processing solutions that require lower chemical usage and that generate less polluting chemical waste.

A wide variety of fixing agents and silver solvents are known. Such materials form relatively stable and soluble reaction products with silver ion or silver halides. Such agents include, for example, alkali metal and ammonium thiosulfates, thiocyanate salts, sulfites, cyanides, ammonia and other amines, imides as described in U.S. Pat. No. 2,857,274; thiols as described in U.S. Pat. Nos. 3,772,020 and 3,959,362; mesoionic 1,2,4-triazolium-3-thiolates as described in U.S. Pat. No. 4,378,424 and other mesoionic heterocyclic thiolates as described in European Patent Application 431,568; thioureas, thioacids, and thioethers as described in German Offen. 2,037,684 and U.S. Pat. Nos. 2,748,000; 3,033,765; 3,615,507; 3,958,992; 4,126,459; 4,211,559; 4,211,562; 4,251,617; and 4,267,256; phosphines as described in U.S. Pat. No. 3,954,473; and concentrated halide solutions as described in U.S. Pat. No. 2,353,661.

Thiosulfate salts are generally preferred as fixing agents because they are inexpensive, highly water soluble, non-toxic, non-odorous, and stable over a wide pH range in the fixer bath. Furthermore, thiosulfate salts form very stable, water soluble reaction products with both silver ion and with silver halides. Sulfite salts are practical fixing agents for the same reasons as thiosulfate mentioned above, except sulfites are not useful for the fixing of silver bromide or silver iodide containing materials. Sulfite salts are effective fixing agents for high chloride elements, as indicated, for example, in U.S. Pat. No. 5,171,658. On a mole for mole basis, sulfites are not as rapid in fixing action as thiosulfates, but sulfites contribute less sulfur waste, less BOD (biochemical oxygen demand), and less COD (chemical oxygen demand) to photographic processing waste than do thiosulfates. Therefore, there is a need to improve the fixing speed of sulfite fixing agents for silver chloride photographic materials so that the environmental advantages of sulfites can be realized.

Thioether compounds have been reported to improve bleaching effectiveness when present in bleach or bleach-fixing baths (for example, British Patent 933,008; U.S. Pat. Nos. 3,241,966; 3,767,401; 4,201,585; 4,695,529; 4,804,618; 4,908,300; 4,914,009; 4,965,176; and 5,011,763; and unexamined Japanese Patent Application JP 02-44,355 A). These references do not disclose the use of thioethers as fix accelerators.

U.S. Pat. No. 4,960,683 of Okazaki et al. describes a method for processing black-and-white photosensitive materials comprising fixing a developed black-and-white spectrally sensitized photographic material in the presence of an aliphatic thioether compound and/or a heterocyclic thiol or thiolate compound. There is no indication that such compounds are useful with sulfite fixing solutions.

The use of ammonium thiocyanate, thiourea, or a thioether (e.g. 3,6-dithia-1,8-octanediol) to accelerate fixing by ammonium thiosulfate is mentioned in U.S. Pat. No. 5,002,861. There is no indication that these compounds are useful with other fixing agents, such as sulfite.

SIR H953 describes a method of processing color photographic materials in which thioether-containing compounds are present in a fixer bath which immediately follows a bleaching bath containing ammonium 1,3-diaminopropanetetraacetatoferrate(III) as the bleaching agent. The reported result of such a process is the improved bleaching of the developed silver in the photographic material. There is no mention of using such compounds with a sulfite fixing agent.

There remains a need for materials or methods that increase the speed of fixing of silver chloride photographic recording materials. Further, there remains a need for materials or methods that increase the fixing speed of sulfite fixers, so that improved processing ecology can be achieved.

SUMMARY OF THE INVENTION

This invention provides a fixing solution having a pH≧7 and comprising a fixing amount of sulfite and a fix accelerating amount of a thioether compound; wherein the fixing solution contains less than 0.05 moles/liter of thiosulfate. It further provides a method of processing an imagewise exposed and developed silver halide photographic element comprising fixing in the above fixing solution a silver halide photographic element, said element comprising at least one emulsion or deposit of silver halide containing greater than 90 mole % silver chloride.

The fixing solutions of this invention provide rapid fixing with the environmental advantage of containing sulfite as the principle fixing agent. Further, they are inexpensive, easily prepared, non-toxic, non-odorous, and stable over a wide pH range.

DETAILED DESCRIPTION OF THE INVENTION

The synergistic combination of a fixing amount of sulfite and a fix accelerating amount of a thioether compound in a fixing solution allows for more rapid fixing than expected based on the fixing ability of a sulfite fixer in the absence of the thioether compounds described herein and the fixing ability of the thioether compounds in the absence of sulfite.

The thioethers of this invention are compounds having at least one bivalent sulfur atom in which the two sulfur valences are satisfied by bonding to two different carbon atoms. The bivalent sulfur atom is not incorporated in an aromatic ring, i.e. a ring such as the thiophene or 1,3-thiazole ring.

The thioether compounds useful in this invention can be monomeric or polymeric. Monomeric thioether compounds useful in this invention can be described by Formulas (I) and (II):

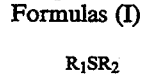

$$R_1SR_2 \quad (I)$$

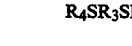

$$R_4SR_3SR_5 \quad (II)$$

where $R_1$, $R_2$, $R_4$ and $R_5$, which may be the same or different, represent substituted or unsubstituted hydrocarbon groups having 1 to about 30 carbon atoms. More preferably $R_1$, $R_2$, $R_4$ and $R_5$ independently contain 1 to 10 carbon atoms. The sulfur atom of Formula (I) is attached to carbon atoms of $R_1$ and $R_2$. The sulfur atoms of Formula (II) are attached to carbon atoms of $R_3$, $R_4$, and $R_5$. The hydrocarbon groups represented by $R_1$, $R_2$, $R_4$ and $R_5$ include saturated or unsaturated, aliphatic or aromatic, straight-chain or branched-chain groups. The groups can contain only carbon atoms or they may contain one or more nitrogen, oxygen, phosphorous, sulfur, or halogen atoms. For example, the groups can contain one or more amino groups; quaternary ammonium groups; imino groups; carbonyl groups; ether groups; thioether groups; carboxylic, sulfuric, or phosphoric acid amide groups; ureido groups; carbamato groups; sulfonyl groups; sulfone groups; and carboxylic, sulfuric, and phosphoric acid ester groups that link together carbon-containing parts of $R_1$, $R_2$, $R_4$ and $R_5$.

The hydrocarbon groups $R_1$, $R_2$, $R_4$ and $R_5$ can be linked together by a bond other than the thioether groups of Formulas (I) and (II), thereby forming a ring compound. The ring containing the sulfur in Formulas (I) and (II) should not be aromatic; in other words it should not have appreciable aromatic character such as illustrated by thiophene and 1,3-thiazole.

The hydrocarbon groups $R_1$, $R_2$, $R_4$ and $R_5$ each may contain saturated, unsaturated, or aromatic ring groups, which may be heterocyclic. Examples of aromatic ring groups include benzene and naphthalene groups. Examples of heterocyclic groups include pyridine and pyridinium, pyrimidine, pyridazine, pyrazine and pyrazinium, morpholine and morpholinium, piperazine and piperazinium, piperidine and piperidinium, pyrazole and pyrazolium, indole and 3H-indolium, benzindole and benz[e]indolium, oxazole and oxazolium, benzoxazole and benzoxazolium, naphthoxazole and naphthoxazolium, naphthothiazole and naphthothiazolium, thiazoline and thiazolinium, imidazole and imidazolium, thiazole and thiazolium, triazole and triazolium, thiadiazole and thiadiazolium, tetrazole and tetrazolium groups, quinoline and quinolinium, isoquinoline and isoquinolinium, benzimidazole and benzimidazolium, benzothiazole and benzothiazolium, benztriazole and benztriazolium, quinoxaline and quinoxalinium, phenazine and phenazinium, groups, for example.

The hydrocarbon groups $R_1$, $R_2$, $R_4$ and $R_5$ may include one or more substituents including amino groups, guanidino groups, quaternary ammonium groups, hydroxyl groups, halides, carboxylic acid or carboxylate groups, amide groups, sulfinic acid groups, sulfonic acid groups, sulfate groups, phosphonic acid groups, phosphate groups, nitro groups, and cyano groups, for example.

The group $R_3$ is a divalent group which separates the two thioether sulfur atoms in Formula (II) by at least 1 carbon atom. Preferably, the two thioether sulfur atoms in Formula (II) are separated by two atoms, both of which are carbon. The group $R_3$ may be, for example, a substituted or unsubstituted ethylene group, including oxalyl and ketenyl groups;a substituted or unsubstituted 1,2-ethenyl group; an ethynyl group; a substituted or unsubstituted 1,2-benzenyl group; a substituted or unsubstituted 1,2- or 2,3-naphthalenyl group; a substituted or unsubstituted 2,3-, or 3,4-pyridinyl group, quinolinyl group, or piperidinyl group; a substituted or unsubstituted 2,3-pyrazinyl group, piperazinyl group, or quinoxalinyl group. The group $R_3$ may have up to about 10 carbon atoms, and more preferably 1 to 5 carbons. Furthermore, $R_3$ may be substituted as described above for $R_1$, $R_2$, $R_4$ and $R_5$.

Preferred monomeric thioether compounds for this invention are compounds described by Formulas (I) and (II) in which one or both of $R_1$, $R_2$, $R_4$ and $R_5$contain guanidine groups or guanidinium groups, and aromatic or aliphatic amine groups or ammonium groups, including heterocyclic amine groups and heterocyclic ammonium groups such as pyridine and pyridinium groups and morpholine and morpholinium groups. More preferred are those described by Formula (II).

Examples of thioether compounds useful in the present invention include, but are not limited to the following:

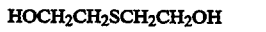

$CH_3SCH_2CH_2OH$ 1

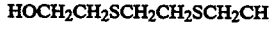

$HOCH_2CH_2SCH_2CH_2OH$ 2

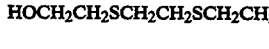

$HOCH_2CH_2SCH_2CH_2SCH_2CH_2OH$ 3

$HOCH_2CH_2SCH_2CH_2SCH_2CH_2SCH_2CH_2OH$ 4

-continued $HOCH_2CH_2SCH_2CH_2OCH_2CH_2OCH_2CH_2SCH_2CH_2OH$ 5

$HOCH_2CH_2OCH_2CH_2SCH_2CH_2SCH_2CH_2OCH_2CH_2OH$ 6

$CH_3SCH_2CH_2CH_2NH_2$ 7

$H_2NCH_2CH_2SCH_2CH_2NH_2$ 8

$H_2NCH_2CH_2SCH_2CH_2SCH_2CH_2NH_2$ 9

$H_2NCH_2CH_2OCH_2CH_2SCH_2CH_2SCH_2CH_2OCH_2CH_2NH_2$ 10

$H_2NCH_2CH_2SCH_2CH_2OCH_2CH_2OCH_2CH_2SCH_2CH_2NH_2$ 11

12

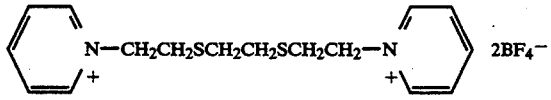

13

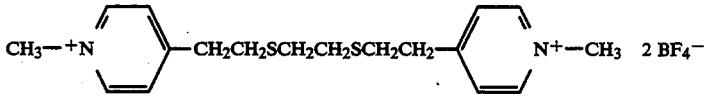

14

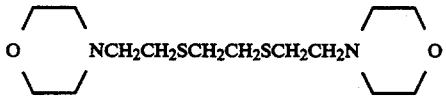

15

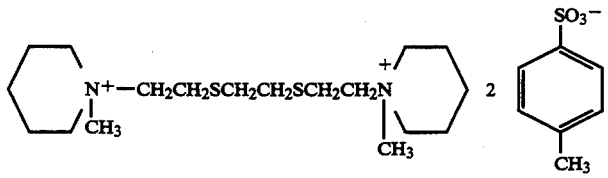

$H_2N(NH)CNHCH_2CH_2SCH_2CH_2SCH_2CH_2NHC(NH)_2.2HCl$ 16

$[(CH_3)_3NCH_2CH_2SCH_2CH_2SCH_2CH_2N(CH_3)_3]^{2+}2Cl^-$ 17

Preferred thioethers for use in this invention are compounds 3, 7, 12, 13, 14, 15, 16, and 17. It is within the scope of this invention to use combinations of two or more thioether compounds to accelerate fixing rates, if desired.

Additional examples of thioether compounds useful in the present invention are the thioether substituted silver halide solvents, fixing agents, emulsion sensitizers, and development accelerators described in U.S. Pat. Nos. 2,521,926; 3,033,765; 3,038,805; 3,057,724; 3,062,646; 3,201,242; 3,271,157; 3,506,443; 3,574,628; 3,574,709; 3,622,329; 3,625,697; 3,813,247; 3,958,992; 4,057,429; 4,126,459; 4,211,559; 4,211,562; 4,251,617; 4,267,256; 4,695,534; 4,695,535; 4,713,322; 4,782,013; and 5,041,367; in Canadian Patent 1,281,580; in British Patent 1,510,651; and in European Patent Application 216,973; the thioether-containing dicarboxylic acids described in U.S. Pat. No. 2,748,000 the thioether-containing organic diols described in U.S. Pat. Nos. 3,021,215 and 3,615,507; the thioether-containing polyalkylene oxide compounds described in U.S. Pat. Nos. 3,241,966 and 4,201,585; the thioether-containing bleaching accelerators described in U.S. Pat. Nos. 4,695,529; 4,908,300; 4,914,009; and 5,002,860; the thioether-containing metal chelating compounds described in U.S. Pat. No. 4,804,618 and their metal complexes; the thioether-containing compounds described in U.S. Pat. No. 4,960,683 and European Patent Application 458,277; and the amine-containing thioether compounds described in U.S. Pat. No. 5,011,763.

The thioether compounds of this invention are dissolved in the fixing solution and should be soluble in the aqueous fixing solution. They may be introduced into the fixing solution from the fixer replenisher or from a solution immediately preceding the fixer (by film carry over) or by introducing the overflow of another thioether containing processing solution into the fixer bath. The concentration of the thioether compounds in the fixing solution should be from about $1\times10^{-4}$ molar to about $5\times10^{-1}$ molar, more preferably from about $1\times10^{-3}$ molar to about $2\times10^{-1}$ molar; and most preferably $1\times10^{-2}$ molar to $2\times10^{-1}$ molar.

The photographic elements of this invention can be any photographic recording material comprising, at the time of fixing with the sulfite fixer, either 1) at least one high chloride silver emulsion or 2) at least one deposit of silver chloride resulting from the bleaching of developed silver by a processing solution with bleaching ability. The other emulsions of the photographic element may have any halide content. For example, the photographic element may also contain silver bromide or silver iodobromide emulsions. Examples of suitable elements include black-and-white photographic films and papers, including microfilms, graphic arts photographic recording materials, X-ray photographic recording materials, scanner photographic recording materials, and CRT photographic recording materials;

color negative photographic papers and films, color photographic transparency or display materials, color print films, and reversal color films and papers.

The silver chloride of the photographic elements that are fixed by the fixer of this invention can be coarse, regular, or fine grain silver chloride emulsions. The emulsions can optionally be chemically and spectrally sensitized. The silver chloride emulsions can have any crystal habit, such as cubic, octahedral, spherical, tabular, and double-structure. They can be monodisperse or polydisperse. The silver chloride emulsions must be comprised of greater than 90 mole percent silver chloride, more preferably greater than 95 mole percent silver chloride, and silver iodide, if present, should be less than about 1 mole percent, more preferably less than about 0.6 mole percent silver iodide.

The silver chloride of the photographic elements that are fixed by the fixer of this invention can also be silver chloride deposits that are formed from the bleaching of developed silver in a bleach bath in which chloride is used as the rehalogenating agent. Such silver chloride could be formed during bleaching in a color negative process or a color reversal process. The silver halide grains of such a deposit should be at least 90 mole % silver chloride. Such deposits may also be formed in the bleaching step of a reversal black-and-white process, following the first development step in which emulsions containing substantially only silver bromide or silver iodide and no silver chloride are developed. In this process, the sulfite fixer is then able to dissolve and remove the AgCl formed in the bleach step, while leaving substantially undissolved the undeveloped AgBr and AgI, which can subsequently be developed to form the reversal (positive) image.

If only fixing baths comprising sulfite as the fixing agent are used to fix the photographic material, that is, no additional fixing bath is used, then it is preferred that all of the silver halide to be fixed be comprised of greater than 90 mole percent silver chloride, more preferably greater than 95 mole percent silver chloride, and silver iodide, if present, should be less than about 1 mole percent silver iodide, more preferably less than about 0.6 mole percent silver iodide. If a bleach composition is used to oxidize developed silver prior to its being fixed by a sulfite fixer, this bleach composition preferably should not contain bromide or iodide because these halides would form silver bromide and silver iodide within the film during bleaching. The silver bromide or silver iodide would be difficult to be fixed by the sulfite fixer.

The sulfite may be provided by ammonium sulfite, sodium sulfite, potassium sulfite, lithium sulfite, magnesium sulfite, or calcium sulfite or mixtures of these sulfites. Alternatively, one or more of sodium bisulfite, potassium bisulfite, ammonium bisulfite, sodium metabisulfite, potassium metabisulfite, and the like may be used to provide the sulfite fixing agent. The concentration of sulfite in the fixing solution can be from about 0.05 M to as high as solubility in the processing solution allows, but it is preferred that this concentration be from about 0.1 M to 2 M. The pH of the fixer bath may range from about 6 to as high as about 12. It is generally preferred that the pH be between 7 and 12, most preferably between about 7 and 11 because fixing by sulfite is most rapid in this pH range. In this most preferred pH range of 7–11, it is preferred that the fixer not contain ammonium ion or ammonia in order not to generate irritating ammonia vapors from the fixer solution. The fixer bath can optionally contain a source of thiosulfate provided that the thiosulfate concentration does not exceed about 0.05 molar. To control solution pH, various buffering agents may be used in the fixer bath, including the above-mentioned sulfite or bisulfite sources, citrates, borates, carbonates, phosphates, etc.

The fixing time employed in this invention is not critical. One may use longer or shorter fixing times, as desired. In instances where longer fixing times are used, generally speaking the sulfite content can be reduced, and the environmental advantages provided by this invention optimized. Thus for example, one may use fixing times of 240 seconds, 480 seconds, or even longer. However, it is preferred to use comparatively short fixing times in order to have greater processing throughput. By incorporating the thioether compounds of this invention, it is possible to minimize the fixing time of the process. For example, one may conduct the fixing process of the invention in as short a time as about 10 seconds. The preferred fixing time is 10 to 480 seconds.

Since the fixing step is a separate step in the overall image-forming process, any processing sequence for black-and-white or color photographic recording materials is contemplated by this invention, as long as a fixing step for silver chloride is part of the overall process. Examples of processing sequences and methods are described in *Research Disclosure,* December 1989, Item 308119, and *Research Disclosure,* December 1978, Item 17643. In the processing of black-and-white photographic recording materials the processing sequences typically include a development step preceding a fixing step, which in turn precedes a final washing or stabilizing step. One or more additional processing steps may come before the development, fixing, and final washing or stabilizing steps, such as other washing steps. These may include a pre-bath and/or washing treatment prior to the development step and a stop bath and/or washing treatment after the development step.

In the processing of color photographic recording materials, the processing sequences typically include one or more color development steps preceding a series of one or more desilvering steps, which comprise bleaching, bleach-fixing, and/or fixing steps. Examples of such processes are Kodak Process C-41 and Kodak Process ECN-2 for color negative films, Kodak Process E-6 and Kodak Process K-14 for color reversal films, and Kodak Process RA-4 for color papers. The process of this invention must include a fixing step in the desilvering sequence. Generally it is preferred that a washing or stabilization step follow the last bleach-fixing or fixing step, but this is not required in order to practice the invention. One or more additional processing steps may come before the color development, bleaching, bleach-fixing, fixing, and/or stabilization steps, such as other washing steps. Examples of photographic process sequences contemplated by the invention include:

- black-and-white development; fixing*; washing or stabilization.
- black-and-white development; bleaching; fixing*; fogging; black-and-white development; washing or stabilization.
- black-and-white development; fogging; color development; bleaching; fixing*; washing or stabilization.
- color development; bleaching; fixing*; washing or stabilization.

color development; bleach-fixing; fixing*; washing or stabilization.

color development; fixing*; bleach-fixing; washing or stabilization.

color development; fixing*; bleaching; fixing; washing or stabilization color development; fixing; bleaching; fixing*; washing or stabilization color development; fixing*; bleaching; fixing*; washing or stabilization In these process sequences, the fixing step designated with an "*" is a fixing step of this invention. Other examples of modifications to the above processing sequences contemplated by this invention include: sequences comprising a pre-bath or washing treatment, a black-and-white development step, a stop bath, a chemical fogging step, and one or more color development steps prior to the color development step that precedes the desilvering sequence; a stop bath and/or washing treatment after the color development step that precedes the desilvering sequence; and a bleach accelerator bath and/or washing step before a bleaching step or bleach-fixing step.

The photographic elements of this invention can be non-chromogenic silver image forming elements. They can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like. This invention may be particularly useful with those photographic elements containing a magnetic backing such as described in No. 34390, *Research Disclosure,* November, 1992.

In the following discussion of suitable materials for use in the emulsions and elements of this invention, reference will be made to *Research Disclosure,* December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Other suitable emulsions are (111) tabular silver chloride emulsions such as described in U.S. Pat. Nos. 5,176,991 (Jones et al); 5,176,992 (Maskasky et al); 5,178,997 (Maskasky); 5,178,998 (Maskasky et al); 5,183,732 (Maskasky); and 5,185,239 (Maskasky) and (100) tabular silver chloride emulsions such as described in EPO 534,395, published Mar. 31, 1993 (Brust et al). Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of this invention can include various dye-forming couplers including but not limited to those described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof can contain, among other things, brighteners (Examples in Research Disclosure Section V), antifoggants and stabilizers (Examples in Research Disclosure Section VI), antistain. agents and image dye stabilizers (Examples in Research Disclosure Section VII, paragraphs I and J), light absorbing and scattering materials (Examples in Research Disclosure Section VIII), hardeners (Examples in Research Disclosure Section X), plasticizers and lubricants (Examples in Research Disclosure Section XII), antistatic agents (Examples in Research Disclosure Section XIII), matting agents (Examples in Research Disclosure Section XVI) and development modifiers (Examples in Research Disclosure Section XXI).

The photographic elements can be coated on a variety of supports including but not limited to those described in Research Disclosure Section XVII and the references described therein.

The following examples are intended to illustrate, without limiting, this invention.

EXAMPLE 1

A silver chloride color photographic paper greater than 98 mole % AgCl (EKTACOLOR EDGE Paper), in the form of strips that were 305 mm long and 16 mm wide, was given a suitable exposure to light and then processed by contacting the strips sequentially with processing solutions as follows:

| Process Step | Process Time, sec | Process Temp, °F. | Process Solution Volume, L | Agitation Type[a] |
|---|---|---|---|---|
| Color Development | 45 | 95 | 8 | 1 |
| Stop Bath | 30 | 95 | | 1 |
| Water Wash | 30 | 90 | 8 | 2 |
| Bleach Bath | 120 | 95 | | 3 |
| Water Wash | 120 | 90 | 8 | 2 |
| Fixer Bath | b) | 95 | 2 | 3 |
| Water Wash | 120 | 90 | 8 | 2 |
| Stabilizer Bath | 60 | 95 | 8 | 4 |

[a]The type of agitation used in the processing solutions was as follows:
1) the solution was continuously agitated by a constant flow of nitrogen gas bubbles through a perforated flat plate at the bottom of the solution tank.
2) the solution was agitated by the constant flow of fresh water into the bottom of the tank, with the overflow going to a drain.
3) the solution was continuously agitated by a constant flow of air bubbles through a perforated flat plate at the bottom of the solution tank.
4) the solution was quiescent, and received no agitation.

[b]The paper was fixed for varying lengths of time to determine the speed of silver halide removal and the time required for complete fixing of the paper in the fixer baths. The paper contained 0.753 g/m$^2$ of silver chloride (expressed as silver) to be fixed, less than 0.01 g/m$^2$ of bromide, and less than 0.005 g/m$^2$ of iodide.

The composition of each processing solution (each is an aqueous solution) is as follows:

| Component | Concentration |
|---|---|
| Color Developer: | |
| Potassium carbonate | 21.2 g/L |
| Potassium bicarbonate | 2.8 g/L |
| Potassium chloride | 1.6 g/L |
| Potassium bromide | 7.0 mg/L |
| Triethanolamine | 12.4 g/L |
| N,N-diethylhyroxylamine | 4.6 g/L |
| 4-(N-ethyl-N-(β-methanesulfonamidoethyl)amino-2-methylaniline sesquisulfate monohydrate | 5.0 g/L |
| 1-Hydroxyethyl-1,1-diphosphonic acid | 0.7 mg/L |
| Phorwrite TM REU | 2.3 g/L |
| Lithium sulfate | 2.7 g/L |
| pH | 10.0 |
| Stop Bath: | |
| Sulfuric acid | 10.0 mL/L |
| Bleach Bath: | |
| Hydrogen Peroxide, 30% in water | 100 mL/L |
| Potassium chloride | 5.0 g/L |
| Potassium Bicarbonate | 25.0 g/L |
| pH | 10 |
| Fixer Baths: | |
| The formulae for the fixer baths are given in the table below | |
| Stabilizer Bath: | |
| PHOTO-FLO TM 200 solution (manufactured by Eastman Kodak Company) | 5.0 mL/L |

In the fixing step one of three fixer baths was used, resulting in three fixing processes to be compared. The contents of the fixer baths are shown in the table below. The fixer baths were at pH 9. Two fixers comprised sodium sulfite. One of the sodium sulfite fixers contained compound 3. The third fixer contained only compound 3.

| Fixer | Sulfite M | Compound 3 M | pH | Remarks |
|---|---|---|---|---|
| 1 | $Na_2SO_3$, 0.21 | | 9 | Comparison |
| 2 | $Na_2SO_3$, 0.20 | 0.01 | 9 | Invention |
| 3 | — | 0.01 | 9 | Comparison |

During fixing, samples of the paper were removed at controlled time intervals, then washed, stabilized, and dried. The silver remaining in the D-min area of the paper was measured by X-ray fluorescence. The silver removed from the paper by each fixer in the specified time, and the time required to completely fix the paper is given in Table I.

TABLE I

| Fixer | Time in Fixer, sec | Silver Removed from paper, $g/m^2$ | Time Required in Fixer Bath to Completely Fix the Paper, sec | Remarks |
|---|---|---|---|---|
| 1 | 50 | 0.481 | >80 | Comparison |
| 3 | 50 | 0.216 | >>500 | Comparison |
| 2 | 50 | 0.753 | 50 | Invention |

The results of Table I show that the thioether compound 3 is effective at accelerating fixing rates of a silver chloride emulsion by a sulfite fixing agent. Adding 0.01 M compound 3 to a 0.2 M sulfite fixer (Fixer 2) results in a much faster fixing rate than the addition of 0.01 M of additional sulfite to a 0.2 M sulfite fixer (Fixer 1). The time required to fix the paper is reduced by more than 37%. Furthermore, the increases in removal rate of silver chloride by the sulfite fixer containing compound (Fixer 2) is greater than the expected increase obtained by adding the rate for the fixer with only compound 3 (Fixer 3) to the rate for the fixer with only sulfite (Fixer 1). For example, after (50) seconds:

$$\text{Silver removed by Fixer 1 } (0.481\ g/m^2) + \text{Silver removed by Fixer 3 } (0.216\ g/m^2) = 0.697\ g/m^2 < 0.753\ g/m^2,$$

After 50 sec of fixing by fixer 2, desilvering of the color paper was complete in both D-min and D-max areas.

EXAMPLE 2

A silver chloride photographic coating was prepared by coating the following layers, in order, on a cellulose acetate film support:

Layer 1 Silver Chloride Emulsion Layer—comprising a cubic silver chloride emulsion at approximately 2.1 $g/m^2$ of silver, and gelatin at 15.1 $g/m^2$.

Layer 2 Protective Overcoat—comprising gelatin at 1.08 $g/m^2$ with 1.75% (by weight to total gelatin in the coating) of gelatin hardener, bis(vinylsulfonylmethyl) ether.

The coating, in the form of strips that were 305 mm long and 16 mm wide, was processed as indicated below:

| Process Step | Process Time, sec | Process Temp, °F. | Process Solution Volume, L | Agitation Type[a] |
|---|---|---|---|---|
| Tap Water Presoak | 600 | 95 | 8 | 1 |
| Fixing (time series) | 20 sec intervals | 100 | 2 | 2 |
| Water Wash | 180 | 95 | 8 | 1 |
| Stabilization | 60 | 100 | 8 | 3 |

[a]The type of agitation used in the processing solutions is as follows:
1) the solution was agitated by the constant flow of fresh water into the bottom of the tank, with the overflow going to a drain.
2) the solution was continuously agitated by a constant flow of air bubbles through a perforated flat plate at the bottom of the solution tank.
3) the solution was quiescent, and received no agitation.

Fixer Baths:

In the fixing step one of five fixer baths was used, resulting in five fixing processes to be compared. The contents of the fixer baths are shown in the table below. The fixer baths were at pH 9. Two fixers comprised sodium sulfite and two fixers comprised potassium sulfite. One of the sodium sulfite fixers and one of the potassium sulfite fixers contained compound 3. The fifth fixer contained only compound 3.

| Fixer | Sulfite M | Compound 3 M | pH | Remarks |
|---|---|---|---|---|
| 1 | $Na_2SO_3$, 0.21 | | 9 | Comparison |
| 2 | $Na_2SO_3$, 0.20 | 0.01 | 9 | Invention |
| 3 | $K_2SO_3$, 0.21 | | 9 | Comparison |
| 4 | $K_2SO_3$, 0.20 | 0.01 | 9 | Invention |
| 5 | — | 0.01 | 9 | Comparison |

Stabilizer Bath:

The stabilizer processing solution contained 5 mL of PHOTO-FLO TM 200 solution (manufactured by Eastman Kodak Company) per liter of tap water.

During fixing, samples of the coating were removed at controlled time intervals, then washed, stabilized, and dried. The silver remaining in the film was measured by X-ray fluorescence. The silver removed from the film by each fixer in the specified time, and the time required to completely fix the film is given in Table II.

TABLE II

| Fixer | Time in Fixer, sec | Silver Removed from Film, $g/m^2$ | Time Required in Fixer Bath to Completely Fix the Film, sec | Remarks |
|---|---|---|---|---|
| 1 | 40 | 0.839 | 200 | Comparison |
| 5 | 40 | 0.312 | >>200 | Comparison |
| 2 | 40 | 1.313 | 100 | Invention |
| 3 | 40 | 0.818 | 200 | Comparison |
| 5 | 40 | 0.312 | >>200 | Comparison |
| 4 | 40 | 1.205 | 100 | Invention |

The results of Table II show that the thioether compound 3 is effective at accelerating fixing rates of a silver chloride emulsion by sulfite fixing agents. Adding 0.01 M compound 3 to a 0.2 M sulfite fixer (Fixer 2 or Fixer 4) results in a much faster fixing rate than the addition of 0.01 M of additional sulfite to a 0.2 M sulfite fixer (Fixer 1 or Fixer 3). The time required to fix the film is cut in half. Furthermore, the increases in removal rate of silver chloride by the sulfite fixers containing compound 3 (Fixers 2 and 4) are greater than the expected increases obtained by adding the rate for the fixer with only compound 3 (Fixer 5) to the rates for the fixers with only sulfite (Fixers 1 and 3). For example, after 40 seconds:

Silver removed by Fixer 1 (0.839 $g/m^2$) + Silver removed by Fixer 5 (0.312 $g/m^2$) = 1.151 $g/m^2$ < 1.313 $g/m^2$, the silver removed by Fixer 2, an inventive fixer.

While the invention has been described in detail and with reference to specific embodiments thereof, it will be apparent to one skilled in the art that various changes and modifications can be made therein without departing from the spirit and scope thereof.

What is claimed is:

1. A method of processing an imagewise exposed and developed color silver halide photographic element comprising fixing a silver halide photographic element containing at least one emulsion or deposit of silver halide comprising greater than 90 mole % silver chloride, in a fixing solution having a pH>7 and comprising at least 0.05 moles/liter of sulfite and from $1\times10^{-3}$ to $2\times10^{-1}$ moles/liter of a thioether compound; wherein the fixing solution contains less than 0.05 moles/liter of thiosulfate.

2. The method of claim 1 wherein said thioether has the formula:

$$R_1—S—R_2$$

wherein $R_1$ and $R_2$ are (a) the same or different, (b) selected from the class consisting of aromatic groups and saturated and unsaturated aliphatic groups having up to 30 carbon atoms, (c) separate or linked by a bond to form a non-aromatic ring, and (d) attached to the sulfur atom by a carbon atom.

3. The method of claim 2 wherein $R_1$ and $R_2$ independently contain a hydroxy group, an aromatic or aliphatic amine or ammonium group, or a guanidine or guanidinium group.

4. The method of claim 3 wherein $R_1$ and $R_2$ independently contain 1 to 10 carbon atoms.

5. The method of claim 1 wherein the thioether has the formula:

$$R_4—S—R_3—S—R_5$$

wherein $R_4$ and $R_5$ are (a) the same or different, (b) selected from the class consisting of aromatic groups and saturated and unsaturated aliphatic groups having up to 30 carbon atoms, (c) separate or linked by a bond to form a non-aromatic ring, and (d) attached to the sulfur atoms by a carbon atom; and wherein $R_3$ is a bridging group which contains up to 10 carbon atoms and which separates the two sulfur atoms in the above formula by at least one carbon atom.

6. The method of claim 5 wherein $R_3$ is an alkylene group which separates the two sulfur atoms in the formula by two atoms, both of which are carbon.

7. The method of claim 5 wherein $R_4$ and $R_5$ independently contain a hydroxy group, an aromatic or aliphatic amine or ammonium group, or a guanidine or guanidinium group.

8. The method of claim 5 wherein $R_3$ is an alkylene group having 2 to 5 carbon atoms which separates the sulfur atoms by two atoms, both of which are carbon; wherein $R_4$ and $R_5$ independently contain a hydroxy, an aromatic or aliphatic amine or ammonium group, or a guanidine or guanidinium group; and wherein $R_4$ and $R_5$ independently contain 1 to 10 carbon atoms.

9. The method of claim 7 wherein $R_4$ and $R_5$ independently contain 1 to 10 carbon atoms.

10. A fixing solution having a pH>7 and comprising at least 0.05 moles/liter of sulfite and from $1\times10^{-3}$ to $2\times10^{-1}$ moles/liter of a thioether compound; wherein the fixing solution contains less than 0.05 moles/liter of thiosulfate.

11. The fixing solution of claim 10 wherein said thioether has the formula:

$$R_1—S—R_2$$

wherein $R_1$ and $R_2$ are (a) the same or different, (b) selected from the class consisting of aromatic groups and saturated and unsaturated aliphatic groups having up to 30 carbon atoms, (c) separate or linked by a bond to form a non-aromatic ring, and (d) attached to the sulfur atom by a carbon atom.

12. The fixing solution of claim 11 wherein $R_1$ and $R_2$ independently contain a hydroxy group, an aromatic or aliphatic amine or ammonium group, or a guanidine or guanidinium group.

13. The fixing solution of claim 12 wherein $R_1$ and $R_2$ independently contain 1 to 10 carbon atoms.

14. The fixing solution of claim 10 wherein the thioether has the formula:

$$R_4—S—R_3—S—R_5$$

wherein $R_4$ and $R_5$ and (a) the same or different, (b) selected from the class consisting of aromatic groups and saturated and unsaturated aliphatic groups having up to 30 carbon atoms, (c) separate or linked by a bond to form a non-aromatic ring, and (d) attached to the sulfur atoms by a carbon atom; and $R_3$ is a bridging group which contains up to 10 carbon atoms and which separates the two sulfur atoms in the above formula by at least one carbon atom.

15. The fixing solution of claim 14 wherein $R_3$ is an alkylene group separating the two sulfur atoms in the formula by two atoms, both of which are carbon.

16. The fixing solution of claim 14 wherein $R_4$ and $R_5$ independently contain a hydroxy group, an aromatic or aliphatic amine or ammonium group, or a guanidine or guanidinium group.

17. The fixing solution of claim 14 wherein $R_3$ is an alkylene group having 2 to 5 carbon atoms which separates the sulfur atoms by two atoms, both of which are carbon; wherein $R_4$ and $R_5$ independently contain a hydroxy, an aromatic or aliphatic amine or ammonium group, or a guanidine or guanidinium group; and wherein $R_4$ and $R_5$ independently contain 1 to 10 carbon atoms.

18. The fixing solution of claim 16 wherein $R_4$ and $R_5$ independently contain 1 to 10 carbon atoms.

* * * * *

UNITED STATES PATENT AND TRADEMARK OFFICE

CERTIFICATE OF CORRECTION

PATENT NO. : 5,424,176

DATED : June 13, 1995

INVENTOR(S) : Eric R. Schmittou, et al

It is certified that error appears in the above-indentified patent and that said Letters Patent is hereby corrected as shown below:

Col. 13, line 47 and Col. 14, line 32.

Delete "pH>7" and insert

-- pH≥7 --

Signed and Sealed this

Seventeenth Day of October, 1995

*Attest:*

*Attesting Officer*

BRUCE LEHMAN

*Commissioner of Patents and Trademarks*